United States Patent [19]

Püschner et al.

[11] 4,187,405

[45] Feb. 5, 1980

[54] DEVICE FOR FUSING AND FIXING A TONER IMAGE ON A CARRIER

[75] Inventors: Herbert A. Püschner, Schwanewede; Helmut Lembens, Wiesbaden, both of Fed. Rep. of Germany

[73] Assignee: Hoechst Aktiengesellschaft, Frankfurt am Main, Fed. Rep. of Germany

[21] Appl. No.: 840,245

[22] Filed: Oct. 7, 1977

[30] Foreign Application Priority Data

Oct. 9, 1976 [DE] Fed. Rep. of Germany ..... 2645765

[51] Int. Cl.[2] ..... H05B 9/06

[52] U.S. Cl. ..... 219/10.55 A; 219/10.69

[58] Field of Search ..... 219/10.55 A, 10.55 M, 219/10.61 R, 10.69, 10.71; 427/22

[56] References Cited

U.S. PATENT DOCUMENTS

| | | | |
|---|---|---|---|
| 3,048,686 | 8/1962 | Schmidt | 219/10.55 A |
| 3,551,199 | 12/1970 | Forster | 219/10.55 A |
| 3,699,899 | 10/1972 | Shiffman et al. | 219/10.55 A |
| 3,764,768 | 10/1973 | Sayer, Jr. | 219/10.55 A |
| 3,961,568 | 6/1976 | Jeppson | 219/10.55 A |

*Primary Examiner*—Arthur T. Grimley

*Attorney, Agent, or Firm*—Schwartz, Jeffery, Schwaab, Mack, Blumenthal & Koch

[57] ABSTRACT

A device for fusing and fixing a toner image on a carrier in an electromagnetic radiation field, utilizing a microwave power transmitter connected to a microwave generator. The transmitter has a plurality of discrete transmitting elements coupled in parallel to the microwave generator and arranged in rows transverse to the direction of carrier travel. The elements are spaced apart within the rows and the rows are offset from one to the next such that uniform energy density for fusing and fixing of the toner image is radiated across the web width of the carrier.

48 Claims, 13 Drawing Figures

FIG. 3
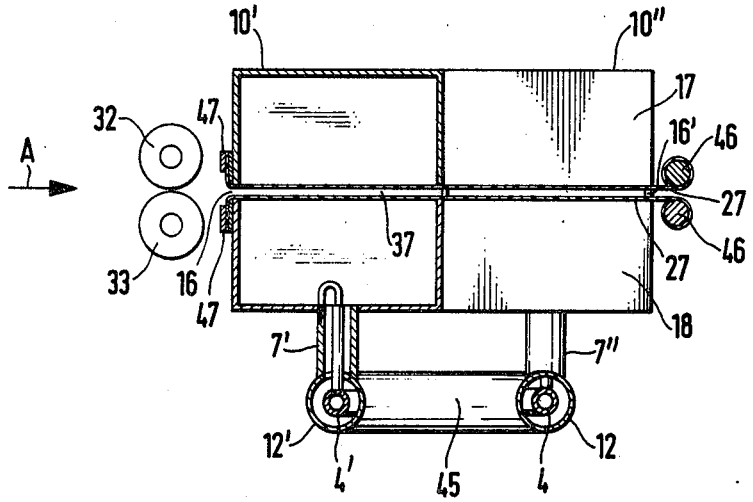
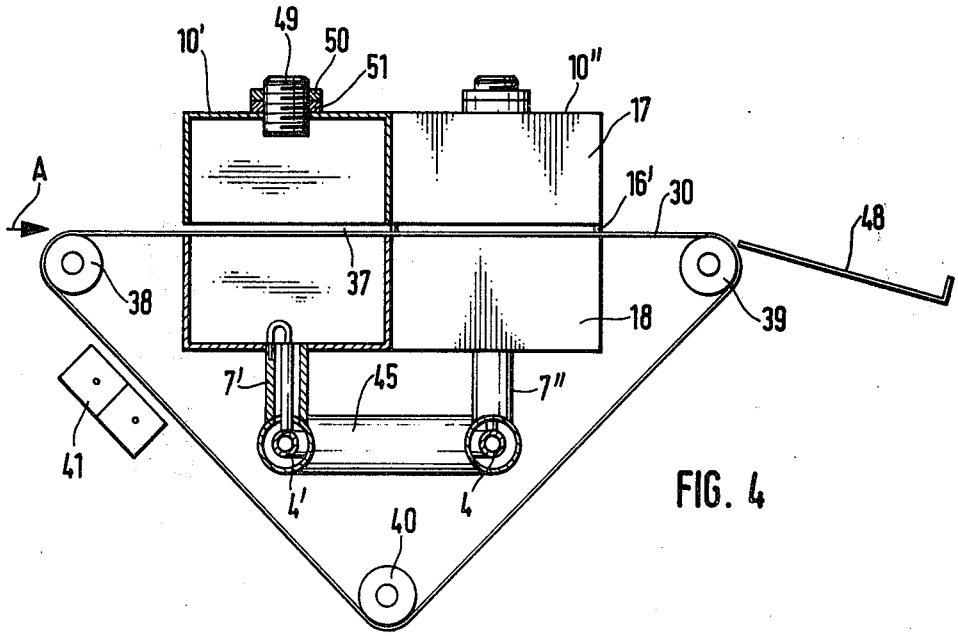
FIG. 4

DEVICE FOR FUSING AND FIXING A TONER IMAGE ON A CARRIER

BACKGROUND OF THE INVENTION

1. Field of the Invention

The invention relates to a device for fusing and fixing a toner image on a carrier in an electromagnetic radiation field, with a uniformly radiating microwave power transmitter connected to a microwave generator and extending across the web width of the carrier.

2. The Prior Art

Such a fixing device working with microwaves is known from German Offenlegungsschrift No. 1,497,204 and consists of a rod-shaped slot radiator which, for the production of a narrow beam of radiation, is embedded in a partly cylindrical reflector, made up of dielectric material, which narrows in the direction towards the image carrier to a belt-shaped radiation aperture. Opposite the radiation exit aperture of this reflector an additional reflector is provided, on the other side of the paper web, to screen or reflect the radiation.

With this device the slot radiator has to be run with very high power in order to deliver sufficient energy for the fusing of the toner particles since in each case only a strip of the paper web, corresponding to the width of the radiation aperture of the reflector, is irradiated for a very short period. A sufficiently uniform fixing is in this case not always guaranteed since the frequency variations of the single microwave radiator manifest themselves completely as variations in the radiated energy.

Further microwave fixing devices are described in U.S. Pat. No. 3,462,285 and consist either of a closed inductance heating loop connected to a high frequency source, through which loop the film with the toner image is fed, or of a dielectric heating device which has an upper and a lower plate on the two sides of the film with the toner image.

These known devices are unsuitable for very wide sizes since, because of the single radiator, the sinusoidal spread of amplitude across the width of the film carrying the image or of the paper web falls away strongly towards the edges and thus the fixing becomes weaker towards the edges.

To achieve a homogeneous spread of amplitude in microwave continuous equipment for the heating of non-metallic material, a transverse radiator is known from German Offenlegungsschrift No. 1,565,266 in which several short-circuited E-sector transverse (magnetic waves) horns in a row next to one another extend across the width of the material to be heated.

The paths or walls betwen the E-horns produce unheated, or only slightly heated, areas on the material passing below.

In the field of electrophotography it is necessary to fix the toner image produced on a carrier. From the point of view of energy requirement, because of the favorable heat transfer, contact fixing represents a favorable process which, however, has the disadvantage that the toner particles caused to fuse remain stuck on the contact-making roll in the form of the image and are transferred onto the next copy in the form of so-called "ghost images", unless appropriate separation and cleaning means are provided to clean the contact-making roll after the transfer. These means increase the construction expenses and do not contribute to an increase in operational reliability.

In addition to contact fixing, contactless fixing means are also used such as, for example, single radiators with focusing reflectors, radiator groups with simple metal sheet reflectors, and flashlight radiators.

These fixing devices have to be fed with more power than is necessary for the fusing of the toner particles on the carrier material. Because of the high element temperatures of such radiators, for example infra-red radiators, which can be between 300° and 400° C., there exists considerable danger of fire for combustible carrier materials such as paper. In particular, in the case of a carrier material made of paper becoming stuck during fixing in the fixing device the danger of fire is very great. The danger of fire in that case cannot even be eliminated merely by switching off the radiator since the coiled filaments of the infra-red radiator, for example, afterglow and can still transfer sufficient energy to the carrier material to set the latter on fire.

Attempts to prevent high heat loading on copying machines which results from the fixing unit by the use of ventilation fans or suction fans are expensive and not very successful since the heat energy removed heats up the room in which the copying machine is placed in an undesirable manner and hence the heat loading on the copying machine does not become less.

Both contact fixing and also contactless fixing with the aid of radiators have the disadvantage of a slow volume heating, which is equivalent to a certain preheating time, the impossibility of an immediate start, and a sluggish reaction of the copying machine. Fixing with microwaves avoids these disadvantages in known fixing means since the energy transfer by the dielectric heating of non-metallic materials is effected by the direct conversion of the electromagnetic energy of the microwaves in the toner and paper. This energy transfer is based on the interaction of polar molecules or polar molecule groups with the alternating electric field of the microwaves. If a paper standstill occurs during the fixing operation within the fixing unit, the resulting switching off of the power supply to the microwave radiator also causes an immediate interruption of the energy transfer. There is no action which like the after-cooling of the radiator gives rise to a further energy transfer even after the standstill of the copying machine. A fire danger is thus to a large extent excluded.

SUMMARY OF THE INVENTION

The object of the invention is to provide a device of compact construction with which toner images can be fused and fixed on a suitable carrier avoiding an inadequate fixing in certain areas of the carrier, and with lower power requirement than with known machines in which infra-red radiators are used for the fixing of the toner image.

This object is achieved according to the invention with a device for fusing and fixing a toner image on a carrier in an electromagnetic radiation field, with a uniformly radiating microwave power transmitter connected to a microwave generator and extending across the web width of the carrier, in that the microwave power transmitter consists of a number of discrete transmitter elements which are arranged in at least two rows, one lying behind the next in the running direction of the carrier; in that a shared waveguide for the power supply to the transmitter elements leads from the microwave generator to the microwave power transmitter; and in that a T-junction branches from the waveguide to connect with feeder lines which are coupled to the corresponding transmitter elements via coupling loops.

The advantages obtained with the invention are that in several chambers lying parallel to one another uniform energy densities are achieved, which is a pre-conditioned for a uniform fixing of large image widths; and that across the width of the carrier no field-free areas occur which lead to insufficient fixing of the toner image on the carrier. Also of advantage is the fact that the unit assembly arrangement of the chambers permits an extension of the fixing equipment to larger widths without too great expense.

The metallic components of the fixing unit are not heated by microwaves so that no superfluous heating of the copying machine occurs and hence no expensive heat protection is required for certain components. It is also favorable that the room in which the copying machine is situated is less strongly heated up than with other copying machines since the machine heat to be dissipated is substantially less on account of the absence of parts to be heated, such as contact rolls or heat radiators. Because of the reduced heat exposure, the heat sensitivity of the fixing unit is also reduced, and a more ecomonical design of the individual components is possible.

In its broadest form the invention comprises a microwave energy generating means coupled to transmitting means for distributing the generated microwave energy uniformly across the web width of a carrier of a toner image, effecting fusing and fixing the toner image on the carrier. The transmitting means comprises a plurality of discrete transmitter elements arranged in at least two rows, one row lying behind the other in the running direction of the carrier, and a network of waveguides coupled for distributing the generated microwave energy to the various discrete transmitter elements. Each discrete transmitter element preferably is formed of upper and lower resonance cavities, with the upper and lower cavities being spaced apart to leave a gap for passage of the image carrier therethrough. Various means are provided for assuring balanced energy distribution to the discrete transmitter elements, and for guiding the carrier through the fusing and fixing device without unduly disrupting the microwave energy field.

BRIEF DESCRIPTION OF THE DRAWINGS

The invention is described in more detail in the text below with the aid of illustrative embodiments represented schematically in the drawings, in which:

FIG. 3 shows a side view in section of a further embodiment of the fixing device with rolls for the guiding and further conveyance of the carrier through the microwave power transmitter;

FIG. 4 shows schematically a side view in section of another embodiment with a conveyor belt for the carrier guided through the microwave power transmitter;

In the figures like parts are designated with like reference numerals.

DETAILED DESCRIPTION OF THE PREFERRED EMBODIMENTS

Figure 1A:
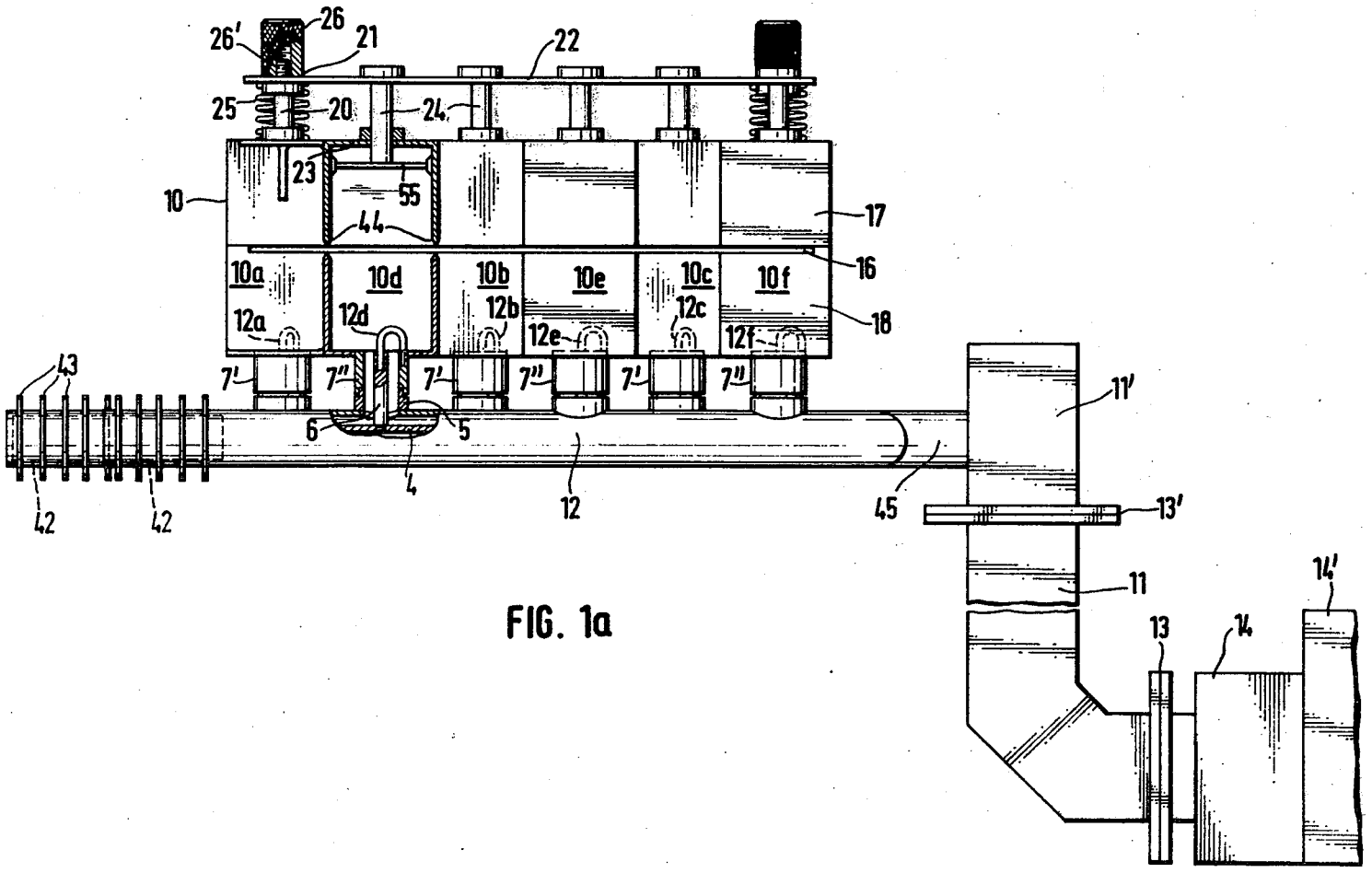
FIGS 1*a* and 1*b* show schematic sectioned views of two embodiments of a fixing device.
Figure 1B:
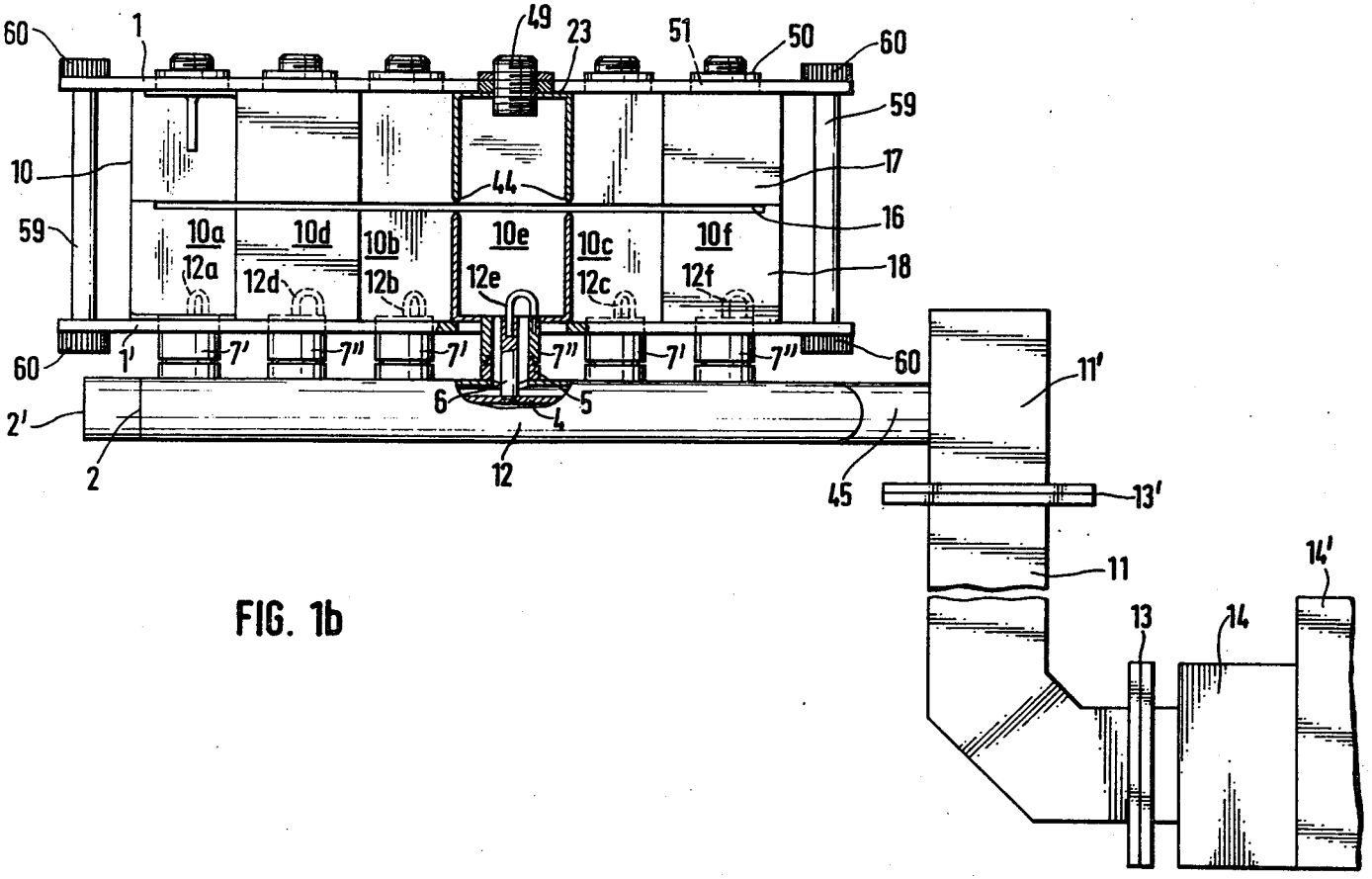
Figure 2A:
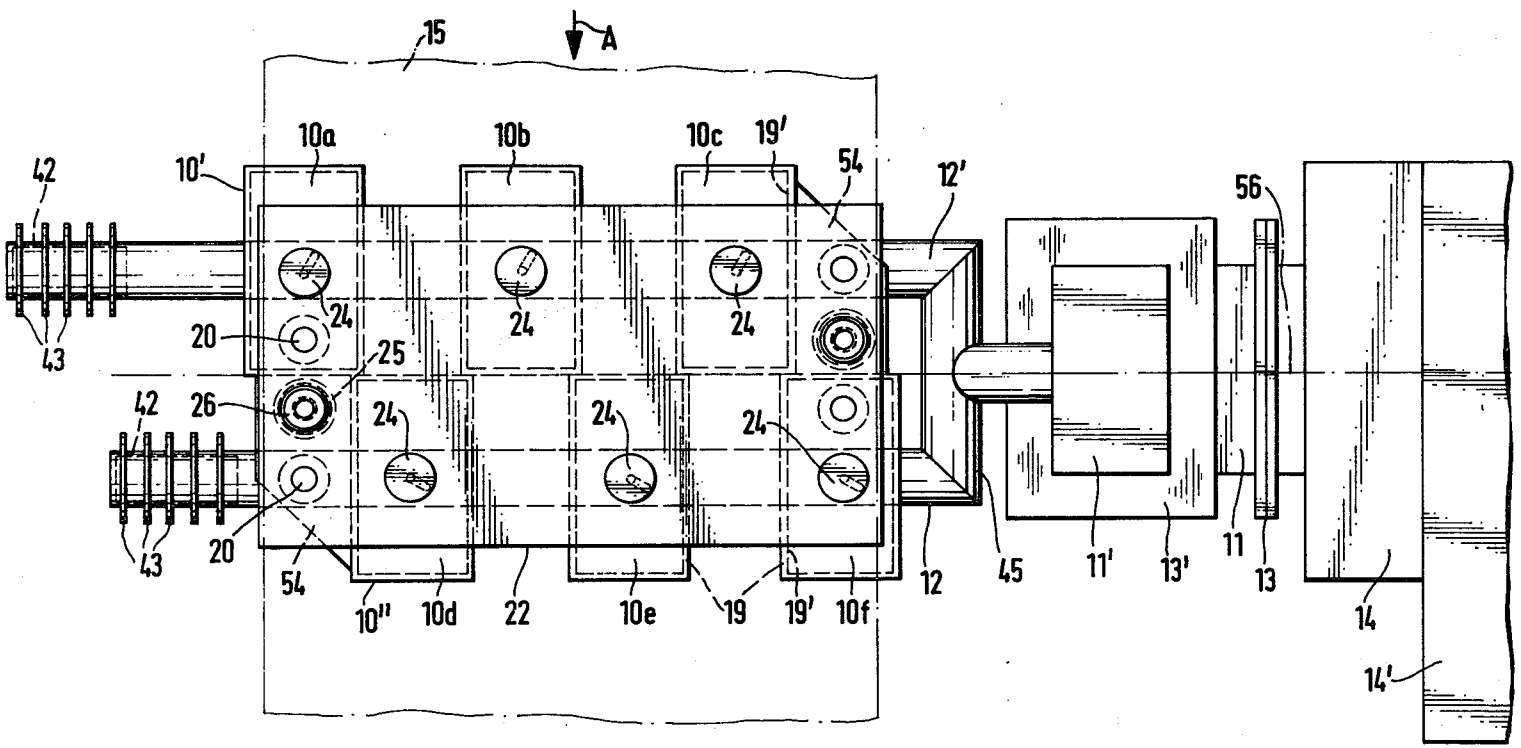
FIGS. 2*a* and 2*b* show plan views of the transmitter elements, offset from each other in two rows, of the two embodiments of the fixing device according to FIGS. 1*a* and 1b, respectively.
Figure 2B:
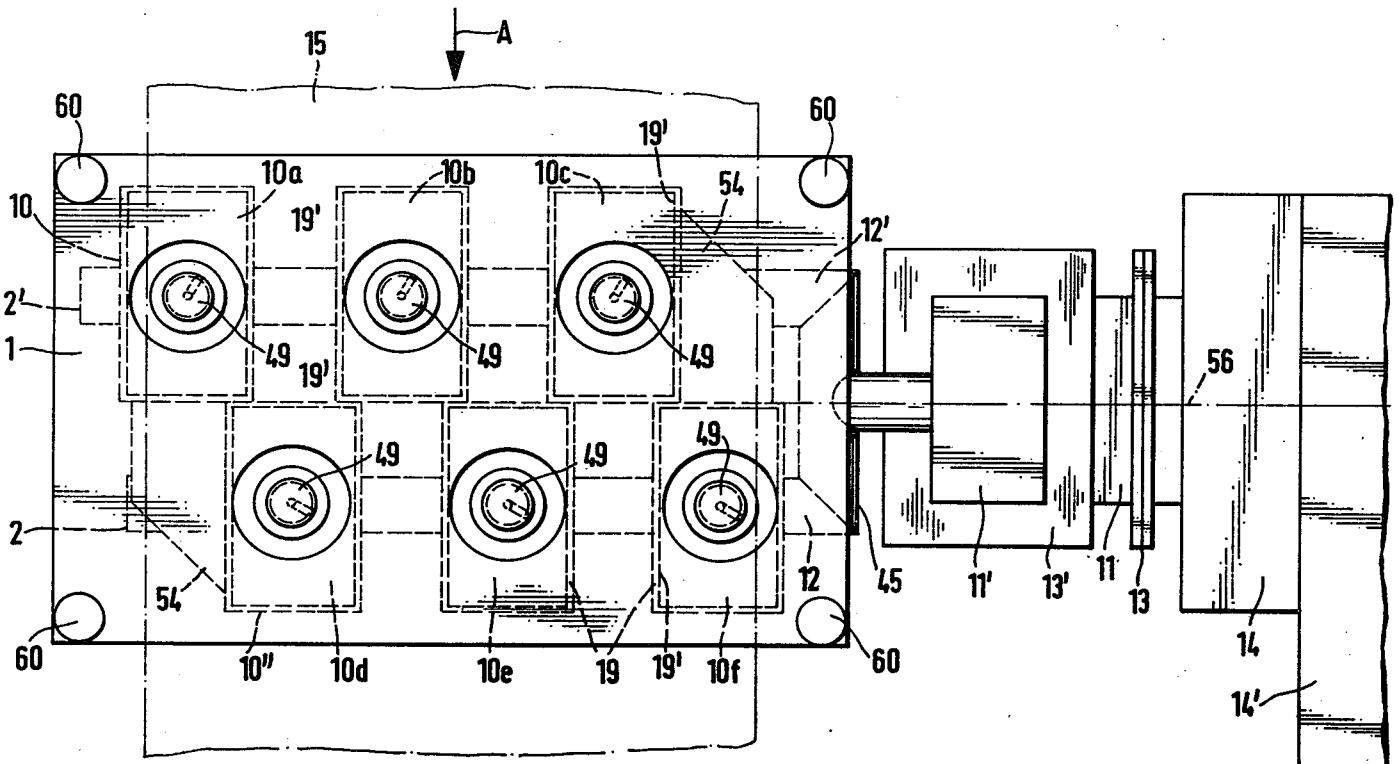

A microwave power transmitter 10, as represented for example in FIGS. 2*a* and 2*b*, consists of a front row 10' and a rear row 10'' of transmitter elements 10*a*–10*f*, the rows being offset with respect to one another. In the preferred form the transmitter elements are rectangular hollow waveguides, which are in themselves known, and which form two-part chamber resonators with upper and lower chambers 17 and 18 respectively, as shown in FIGS. 1*a* and 1*b*. The two-part chamber resonators are fastened in the embodiment of FIGS. 1*b*, 2*b* on two mounting plates 1, 1' which are so connected together by means of adjustable spacer pieces 59 that between the wide side of each upper chamber 17 and the wide side of each lower chamber 18 a through-gap is formed on the front side and a gap on the rear side. The transmitter elements 10*a*–10*f* can be assembled on the unit assembly system principle with the outer longitudinal walls 19 adjacent to one another to form the microwave power transmitter 10, in such a manner that the gaps on the front wide sides of the transmitter elements form an entrance gap 16 extending over the web width of an image carrier 15, and the gaps of the rear wide sides of the transmitter elements form an exit gap 16'. Gaps 16 and 16' act as a passage for carrier 15. The transmitter elements 10*a* to 10*f* in the two rows 10', 10'', for example, are so offset transversely to the running direction of the carrier 15 that the inside surfaces 19' of transmitter elements of one row overlap those of the next row, as shown in FIG. 2*b*.

The upper mounting plate 1 on which the upper chambers 17 are fastened can be lifted, after release of the knurled screws 60, so that all transmitter elements are accessible inside.

A shared waveguide 11 leads from a microwave generator 14, having a power supply 14' to the microwave power transmitter 10. A terminal member 11' of the shared waveguide 11 ends in a T-junction 45, to which two feeder lines 12, 12', parallel to each other, are joined. Coupling loops 12*a*–*f* branch from feeder lines 12, 12', projecting into the corresponding transmitter elements 10*a*–*f* and inductively coupling the transmitter elements to the feeder lines 12, 12'. The microwave generator 14 operates, for example, in a frequency range higher than $10^9$ Hz, preferably at a frequency of 2450 MHz, with an electric alternating field strength which lies below the breakdown field strength so that, with high reliability, material damage by arcing is avoided.

Figure 2C:
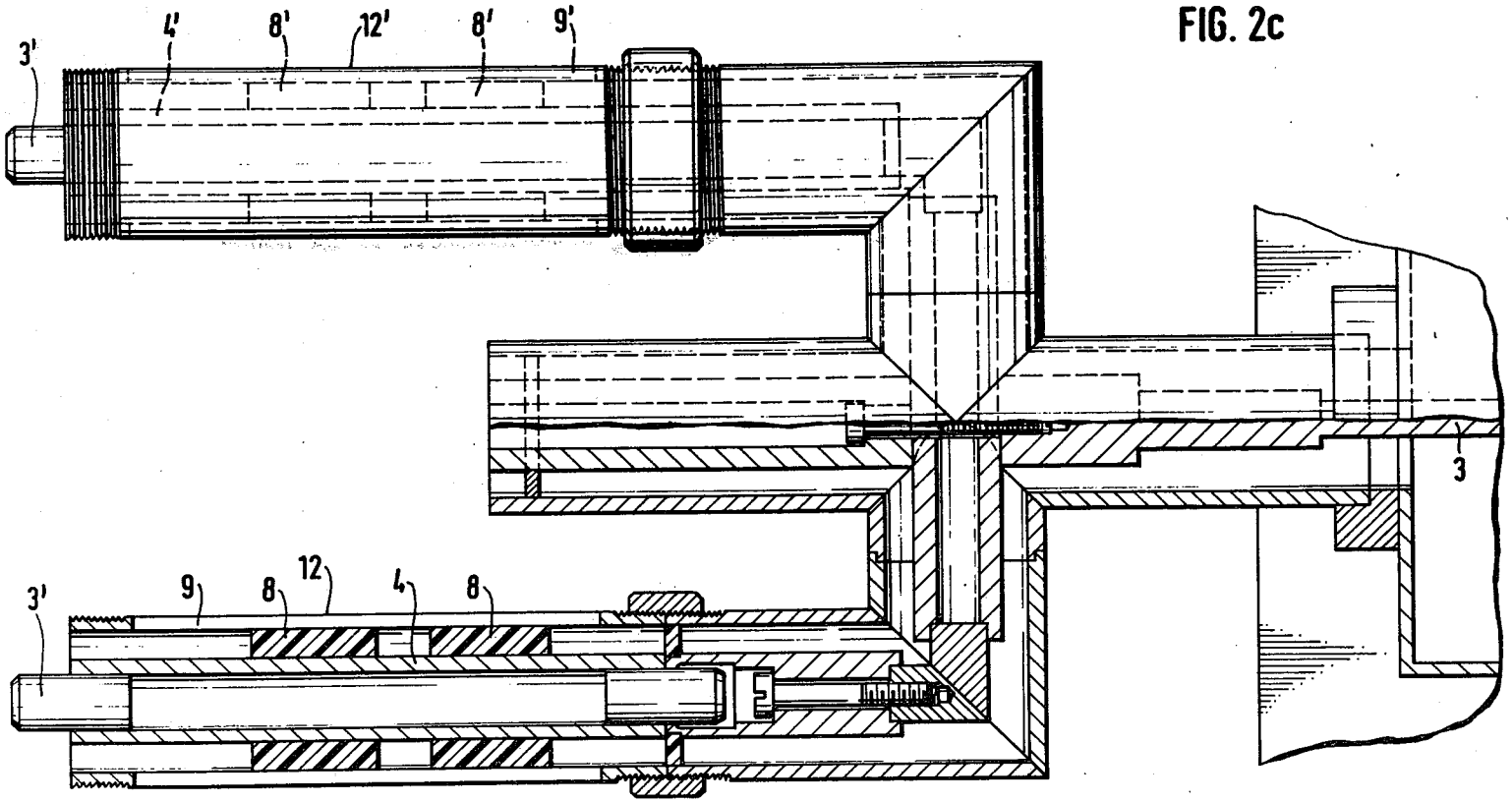
FIG. 2*c* shows a plan view of a T-junction between a waveguide and feeder lines of the fixing device.

The feeder lines 12, 12' are designed coaxially and have inner hollow waveguides 4, 4', as shown in FIG. 2*c*. The inductive coupling loops 12*a* to *c* of the front branch of the transmitter elements are each surrounded by a tube 7', and those of the rear branch each by a tube 7'', as shown in FIGS. 1*a* and 1*b*.

In the wall of the inner hollow waveguide 4, 4' a contact bolt 6 is screwed in vertically in the center line of each tube 7', 7'', the upper end of the bolt ending in the bottom of the lower chamber 18 of the corresponding transmitter element. The contact bolt 6 has a blind hole in which the end of the longer limb of the coupling loop is inserted. The curve of the coupling loop projects into the interior of the lower chamber 18, and the end of the shorter limb of the coupling loop is received by a hole in the cylindrical wall of the tube 7', 7''. The tube 7', 7'' rests on a tube support 5 of the inner hollow waveguide 4, 4'. The transmitter elements or resonators of each branch, coupled inductively with their respective coaxial feeder line, are connected in parallel. The inductive coupling loops of the resonators of the front row 10' are in approximately the one o'clock position in the plan view of FIG. 2*b*, while the coupling loops of the rear row 10'' are in approximately the four o'clock position in the plan view of FIG. 2*b*. The coupling loops of each branch can also take up a different position from that mentioned, the essential point being that they must be parallel to one another within a branch.

As shown in FIGS. 1*a* and 1*b*, a knee-shaped part of the waveguide 11 is joined at one end to the microwave generator 14 with the aid of a coupling element 13, while a further coupling element 13' joins the other end of the knee-shaped part to the terminal member 11' of the waveguide 11. The T-junction 45 branches off at a right angle from the terminal member 11' of the waveguide 11, as shown in FIGS. 1*a*, 1*b*. It will be apparent to those skilled in the art that the waveguide 11, the T-junction 45 and the coupling loops 12*a–f* can also take up different positions relative to one another, or assume different shapes, from those represented.

Longitudinal slots 9, 9' are provided on the entrance side in the two feeder lines 12, 12' of FIG. 2*c*, in which short-circuit plungers 8, 8' made of synthetic material, such as polytetrafluoroethylene, can undergo sliding adjustment. The short-circuit plungers may have the shape of small plates or blocks, and are connected in series as matching means before the chamber resonators. By use of the short-circuit plungers, the power supplied can be selectively distributed to the chamber resonators, for example for image carrier sizes such as the JB4 size (257 mm×364 mm) in the ratio 3/3, and the DIN A4 size (210 mm×297 mm) in the ratio 3/2. This means that with a JB4 image carrier size the three chamber resonators of the front row as well as the three chamber resonators of the rear row are fully applied, while with a DIN A4 image carrier size the three resonators of the front row 10' and the two resonators of the rear row 10'', which in the image carrier travel direction lie nearer to the right-hand edge of the carrier 15, are fully applied. The third resonator of row 10'', furthest away from the right-hand edge of the carrier 15, remains switched off for the DIN A4 image carrier size.

As shown in FIG. 2*c*, the two branches of the T-junction 45 have coupling pins 3' at their ends which make the connection with the feeder lines 12, 12'. A further coupling pin 3 joins the T-junction 45 to rectangular hollow waveguide 11 without reflection.

The movable short-circuit plungers 8, 8' can also be replaced by fixed short-circuit plungers, if desired.

The fixing device has a certain power consumption in full operation which is set according to the number of transmitter elements and the width of the toner image to be fixed on the carrier 15. Thus the problem arises as to how the energy not required on a possible completely empty running of the fixing device, or a partially empty running, in the case of a toner image to be fixed on a narrower-sized carrier, can be disposed of without the microwave generator 14 being thereby adversely affected. In the embodiments according to FIGS. 1*a*, 2*a*, 7 and 10 this problem is solved by providing a terminal load 42 on each of the ends of the two feeder lines 12, 12', as shown in broken lines in those figures. This terminal load 42 can take up the total power of the microwave generator 14 for a short period, and a part of this power over a longer period, such as would be the case with continuous use of a carrier 15 whose size is narrower than that for which the fixing device is designed. The terminal load 42 must then be so designed that it can continuously absorb the surplus power; that is to say, the heat occurring in the terminal load 42 on continuous copying must be dispersed, for example, with the aid of cooling ribs 43 which are attached to the outsides of the feeder lines 12, 12' in the region of the terminal load 42.

Further possibilities for the removal of the surplus energy converted into heat consist in using a circulator with the fixing device, as in the embodiments represented in FIGS. 1*b*, 2*b*, 3 to 6, 8 and 9, or in providing automatic resonance-tuning for the microwave generator to correspond to the energy take-up of the fixing device. The circulator has the advantage that a very accurate energy balance is possible with its aid. With automatic resonance-tuning the energy consumption of the fixing device is continuously measured and fed back to the microwave generator. This method pre-supposes, however, that the central frequency of the microwave generator remains constant within very narrow limits, which could hitherto not be guaranteed with sufficient reliability, and furthermore requires appreciable technical effort to stabilize the frequency of the microwave generator.

In the embodiments according to FIGS. 1*a* and 2*a*, and 1*b* and 2*b*, three transmitter elements or resonators 10*a*, 10*b* and 10*c*, and 10*d*, 10*e* and 10*f* are located in each of the two rows 10', 10'', but the invention is in no way limited to such a six-chamber arrangement. Rather, it is also possible that in the one row three transmitter elements and in the other row two transmitter elements are provided, or that more than three transmitter elements are present in each row.

Figure 5:
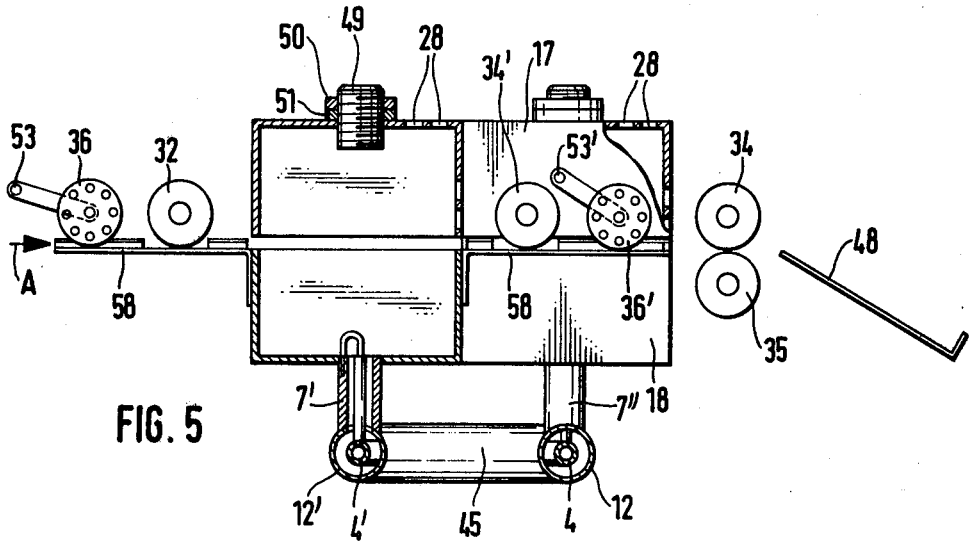
FIG. 5 shows a schematic sectioned view of the side of another embodiment of the fixing device, with delivery rolls for the carrier located between the transmitter elements, and with a carrier web connected to the transmitter elements.
Figure 6:
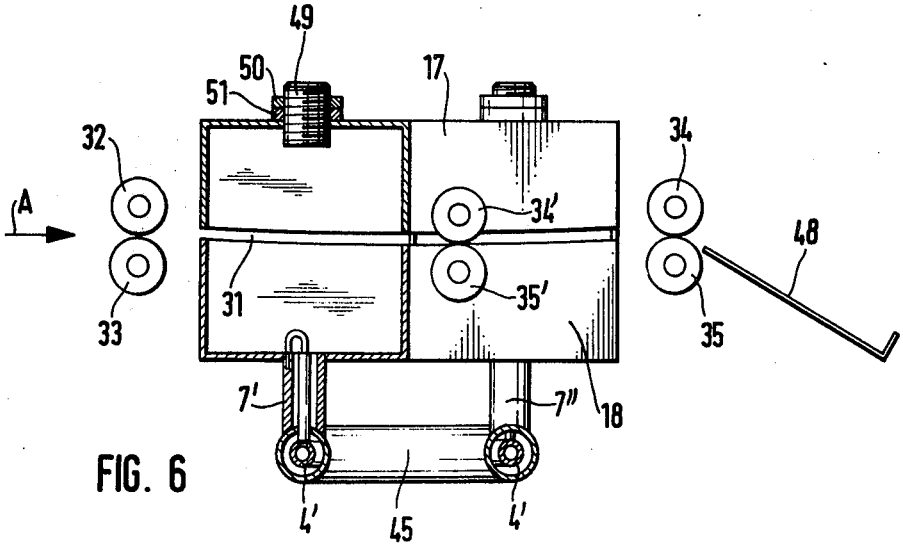
FIG. 6 shows a sectioned side view of a fixing device which is only slightly modified from the embodiment according to FIG. 5.
Figure 7:
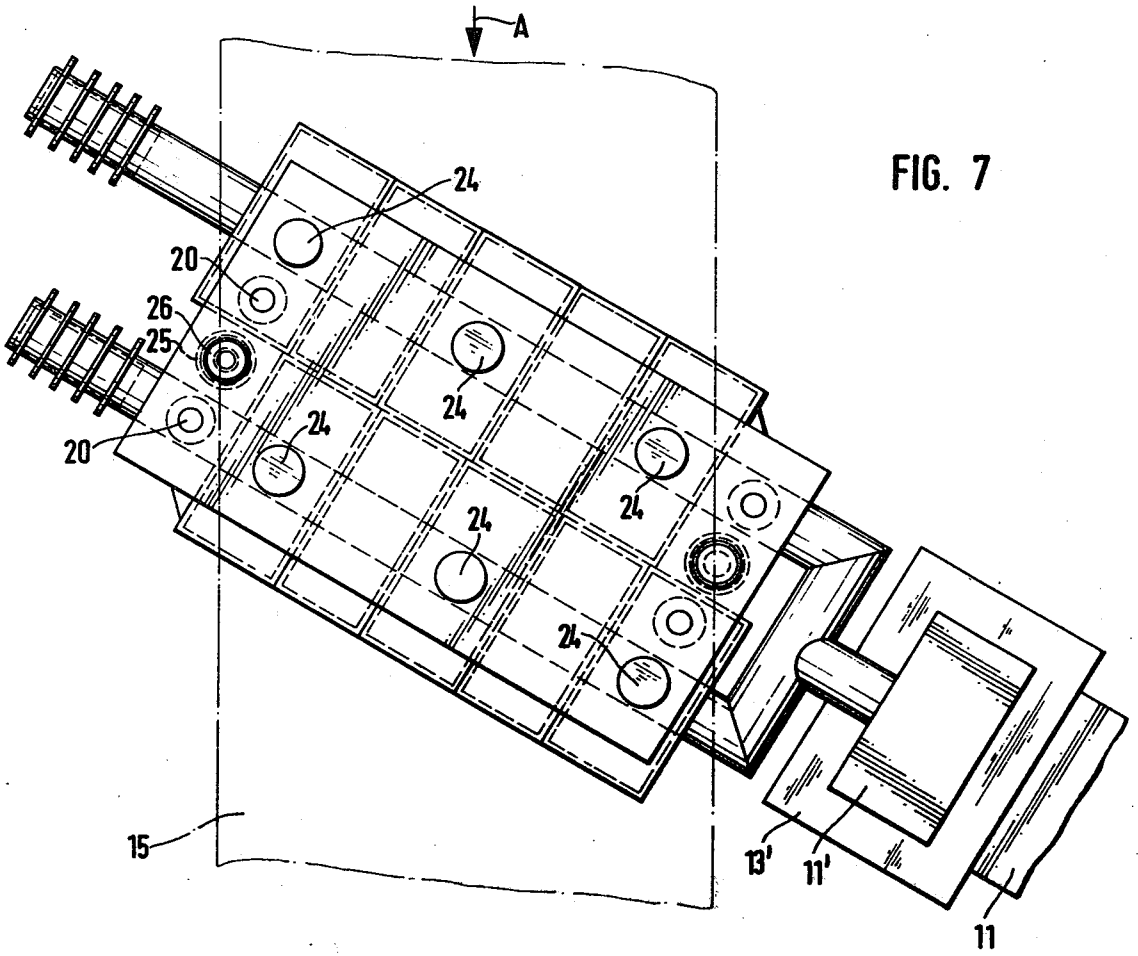
FIG. 7 shows, in plan view, the fixing device similar to that according to FIG. 2*a*, at an angle to the direction of running of the carrier.

In the embodiments shown in FIGS. 1–10, with the exception of FIG. 7, the longitudinal walls 19 of the transmitter elements 10*a–f* are aligned in the running direction of the carrier 15. However, the fixing device represented in FIG. 7 makes an angle other than 90° between the wide sides or longitudinal walls of the transmitter elements and the running direction of the carrier 15.

In order to achieve an optimum arrangement of the entire fixing device with respect to the uniformity of the fixing of the toner image, the front and the rear rows of transmitter elements 10*a–f* are, as already mentioned, offset relative to each other, and the transmitter elements in the rows 10', 10'' are positioned so as to fill gaps. As shown in FIG. 1*a*, longitudinal walls 19 of the transmitter elements 10*a–f* are more appropriately tapered in the direction of the carrier 15, in which case the longitudinal walls can, for example, have a taper 44 on the lower 10 mm of the wall down to a wall thickness of 1 mm or less.

This measure, together with measures described below, effects an adequate fixing of the toner image carried past on the carrier 15, below the longitudinal walls 19 of the transmitter elements 10*a–f*. The further measures consist in the transmitter elements 10*a–c* of the front row 10' being offset relative to the transmitter elements 10*d–f* of the rear row 10'' by the wall thickness of the longitudinal wall 19 of a transmitter element in such a way, transverse to the running direction of the carrier 15, that the inside surfaces 19' of the longitudinal walls 19 of the transmitter elements of the front row are in alignment with the inside surfaces of the longitudinal walls 19 of the transmitter elements of the rear row, as represented by broken lines in FIG. 2*a*. It is also possible that the transverse off-setting of the two rows 10' and 10'' is chosen to be greater than the wall thickness of a longitudinal wall 19, so that the inside surfaces 19' of transmitter elements following behind each other are not in alignment with each other, but are at a distance from each other or overlap in the transverse direction, as can be seen in FIG. 2*b*. With either embodiment, energy distribution across the full web width of the carrier is assured.

In the embodiment shown in FIGS. 1*a* and 2*a* a short-circuit plunger 55 is located horizontally in the upper chamber 17 of each transmitter element. By adjusting the height of this short-circuit plunger 55 with the aid of a common adjustment device 21, the tuning of the resonant frequency of the chamber is effected. Such tuning is an essential precondition for uniform fixing, especially for large width carriers 15. In the embodiment of FIGS. 1*a* and 2*A* each of the cover surfaces 23 of the radiator elements 10*a* and 10*f* has an extension 54 with oblique terminal edges, as shown.

The adjustment device 21 comprises, among other things, a plate 22 covering the greater part of the two rows 10', 10'' of transmitter elements 10*a* to *f*. On this plate 22 guide rods 24 are fastened and these are passed in a sealed manner through the particular cover surface 23 of each transmitter element to the corresponding short-circuit plunger 55, and are rigidly connected to the latter. Every displacement of this plate 22 effects a movement of the guide rods 24 and hence a height adjustment of the short-circuit plungers 55 fastened to them, thus ensuring that the plungers are uniformly and simultaneously adjusted in height and that in every single transmitter element the same energy density is obtained. The plate 22 is supported against the cover surfaces 23 of the transmitter elements with the aid of two compression springs 25, located skew-symmetrically to the center line 56 of the microwave power transmitter 10. Each of the two compression springs 25 is at the same distance from the center line 56 of the microwave power transmitter 10 and rests with one end against the extension 54 of the outer transmitter element 10*a* of the front row 10', or of the outer transmitter element 10*f* of the rear row 10'', respectively, and with the other end against the under side of the plate 22. The displacement of the plate 22 is effected, against the pressure of the springs 25, with the aid of two adjustment nuts 26 which are positioned on the upper side of the plate 22, above the compression springs 25. The adjustment nuts 26 engage with threaded bolts 26' which are fastened to the upper side of cover surface 23 and pass through plate 22. In the direction of running A of the carrier 15 guide bolts 20 are provided on the respective sides of each adjustment nut 26, which guide bolts connected at one end to the extension 54 of the cover surface 23 of the transmitter element 10*a* or 10*f*, or the cover surface 23 itself, and having the other end passing through the plate 22. These guide bolts 20 prevent a tilting of the plate 22 during its vertical displacement when the adjustment nuts 26 are turned.

The embodiment of the fixing device shown in FIGS. 1*b* and 2*b* is similar to the embodiment of FIGS. 1*a* and 2*a*, except that common adjustment means for all transmitter elements is not provided. Instead, a tuning screw 49 is provided in the cover surface 23 of each transmitter element, to permit setting the chamber resonant frequency to be the same for all transmitter elements. Each tuning screw 49 engages with a nut 51 on the cover surface 23, and is locked by means of a lock nut 50. Each tuning screw 49 also projects in general several millimeters into the interior of the upper chamber 17 of each transmitter element. In place of terminal load conducting short-circuit plane surfaces 2, 2' are provided which close the feeder lines 12, 12', and are at a distance of approximately $\lambda o/4$ from the first resonator of each branch, where $\lambda o$ is the wavelength of the resonant oscillation.

It is also possible to construct the transmitter elements 10*a–f* without tuning screws or displaceable short-circuit plungers, in that the upper chambers 17 and the lower chambers 18 of the transmitter elements are each manufactured as casting made with exact dimensions. With exactly identical dimensions of the chambers of the individual transmitter elements, the individual transmitter elements have identical resonance, so that a tuning of the energy density in the individual transmitter elements can be dispensed with. The construction of this embodiment of the invention is represented in FIG. 3, in which the upper and lower chambers 17, 18 of the transmitter elements, opening to an image carrier path 37 through the microwave power transmitter 10, are each closed with a film 27 made of synthetic material. These films 27 prevent ingress of dirt particles into the interior of the chambers, and thus contribute to a constant energy density in the transmitter elements. The films 27 can be made of, for example, polytetrafluoroethylene or copolymers of tetrafluoroethylene and hexafluoropropylene. Near to the entrance gap 16 a pair of guide rolls 32, 33 is provided for the transport of the carrier 15 coming from the direction A.

The films are fastened at one end on the outside of the outer transmitter element with the aid of clamping members 47, while the other ends of the films 27 are set under tension with the aid of torsion springs 46, so that the films always have a smooth surface without any crease formation. The torsion springs 46 are provided near to the exit gap 16'.

In the embodiment shown in FIG. 5 a carrier support track 58 is fastened to the walls 19 in each row of the transmitter element, which carrier support track is in contact with a guide roll 32 or a delivery roll 34'. The delivery roll 34' is located, for space-saving reasons, within the rear row 10'' of the microwave power transmitter 10 between two adjacent transmitter elements of this row. In front of the guide roll 32 a perforated disk 36 is located, which is hinged at a pivot 53 so that it can freely move. This perforated disk 36 which is set in rotation by the carrier 15 works in conjunction with a light barrier from a photocell with a built-in light source, which is not illustrated. On a standstill or alteration of the frequency of movement of the perforated disk 36 over a pre-set period the microwave generator 14 is, for example, switched off in order to save power, and to prevent fusing of the toner if paper jamming should arise. The perforated disk 36' located after the delivery roll 34' is likewise hinged movably at a pivot 53', and rests on the carrier support track 58. The perforated disk 36' forms together with a photocell with a built-in light source, which is not illustrated, a further light barrier as an automatic controller of the running for the fixing device. As soon as the carrier 15 emerges with its front edge out of the exit gap 16' it is taken up by the delivery rolls 34, 35 and transported into a stacker 48. In the cover surfaces of the transmitter elements openings 28 are provided for the ventilation of the transmitter elements. Moreover, a suction fan, which is not illustrated, can be provided above the cover surfaces 23, which suction fan removes the condensate which has formed in the transmitter elements, for example, during the standstill of the microwave power transmitter. In place of a suction fan a ventilation fan can also be used.

FIG. 4 shows an embodiment in which an endless belt 30, running round three rolls 38, 39, 40, located as corner points of a triangle, is fed through between the upper and the lower chambers 17, 18 of the microwave power transmitter 10. At a slight distance from the surface of the belt 30 a corona device 41 is located, with the aid of which the surface of the belt 30 is electrostatically charged. By this means the carrier 15, fed from the direction A, adheres firmly to the belt 30, and does not become displaced during the passage through the transmitter elements. As material for the belt 30 polytetrafluoroethylene or another synthetic material is used which has the property of not being destroyed by the microwave field and in addition has a minimal loss factor so as not to adversely affect the microwave field.

The embodiment represented in FIG. 6 has a slightly curved carrier path 31 and is equipped with two delivery rolls 34', 35' which are in contact with each other at the height of the lower edge of the carrier path 31, and are located in the rear row 10'' each in the interspace between two adjacent transmitter elements in order to take up and further transport the carrier 15 emerging from the front row 10'.

The oblique arrangement of the fixing device relative to the direction of running A of the carrier 15 according to FIG. 7 provides good fixing of the toner image on the carrier 15, even in the intermediate zones which are fed through under the longitudinal walls 19 of the transmitter elements. The oblique arrangement permits a constant image quality in these intermediate zones, the transmitter elements being adjacent to one another in the two rows 10', 10'', without interspaces.

Figure 8:
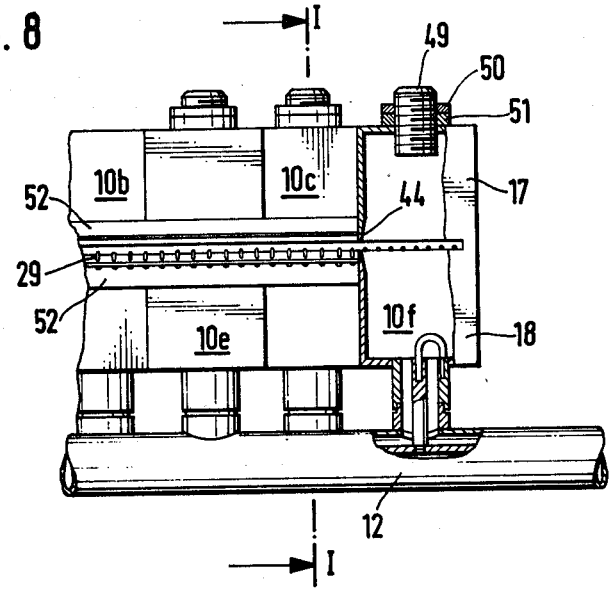
FIG. 8 shows a schematic, partially sectioned and partially perspective view of a further fixing device in which threads are extended from an entrance slot to an exit slot for supporting the carrier.
Figure 9:
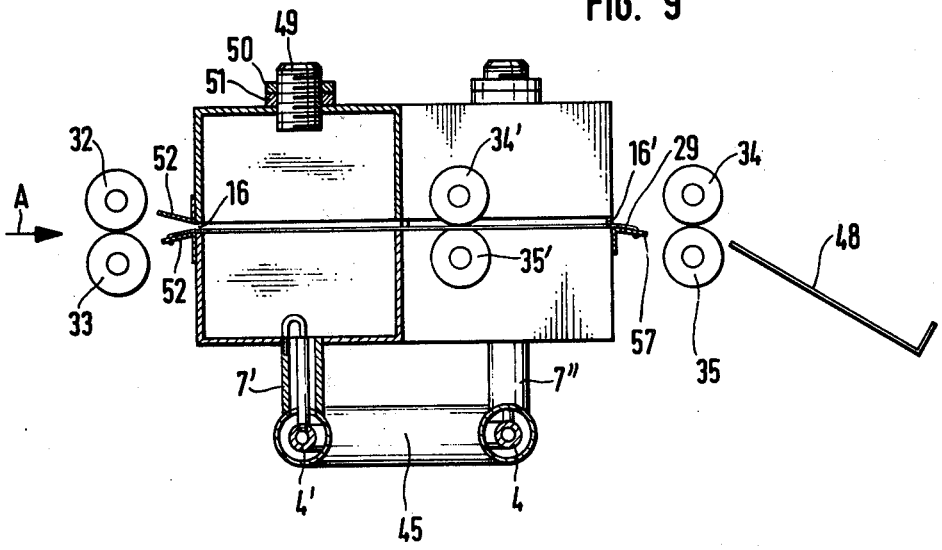
FIG. 9 shows a section of the fixing device according to FIG. 8 along the line I—I.

The fixing device according to FIGS. 8 and 9 is similar to that according to FIG. 6, but having a straight path through the microwave power transmitter 10. Both above and below the entrance gap 16 feed plates 52 extend from the front longitudinal wall of the transmitter elements in the direction of the guide rolls 32, 33, the guide rolls being located in front of the fixing devide. An exit plate 57 is located on the rear longitudinal wall of the transmitter elements as an extension of the lower edge of the path, and leads the carrier 15 emerging from the exit gap 16' towards the delivery rolls 34, 35, from which it is forwarded into the stacker 48. On the lower feed plate 52 are fastened threads 29 stretched parallel to one another, running between the upper and lower chambers 17, 18, parallel to the running direction of the carrier, through the microwave power transmitter 10 and connected to the exit plate 57. The threads 29 prevent ingress of edges or corners of the carrier 15 into the interior of the lower chambers 18. The threads 29 are made of, for example, synthetic material, and serve primarily to guide the carrier 15 in a fashion similar to the film 27 of the FIG. 3 embodiment. Like film 27, threads 29 possess a very small loss factor so that an impairment of the microwave field by the threads 29 is to a large extent avoided.

Figure 10:
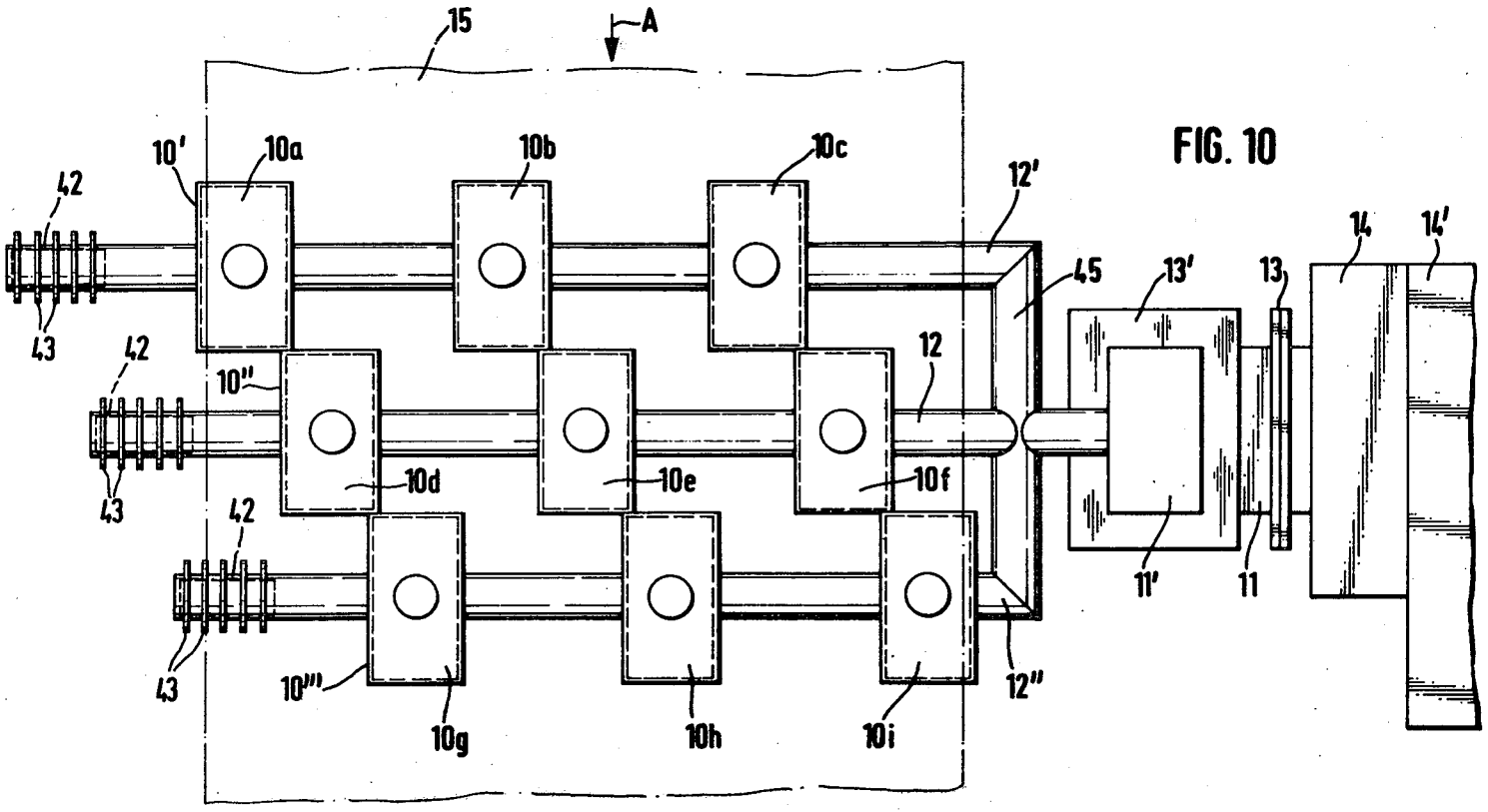
FIG. 10 shows, schematically in plan view, an embodiment with three rows of transmitter elements.

FIG. 10 shows an embodiment with, for example, three rows 10', 10'', 10''' of transmitter elements **10*a* to 10*h***, the transmitter elements being offset in a direction transverse to the carrier travelling direction from one row to the next. The distance between two adjacent transmitter elements in the same row is equal to double the interior width of a transmitter element chamber, but this distance can also be chosen to be greater or smaller than two chamber widths, as appropriate. It is obvious that even four or more rows, according to requirements and insofar as it is justified technically and economically, can be provided.

The following can be said on the mode of operation of the microwave fixing device:

For rapid heating of the toner an electric alternating field of high field strength is set up, the chamber-shaped cavity resonator with the $H_{101}$ fundamental oscillation being particularly suitable for paper sheets used as the carrier 15. The electric field possesses the highest possible field strength in the center of the chamber where the lines of force are directed parallel to the narrow side. The not excessively wide gaps in the plane of symmetry of the resonators between the upper and the lower chambers, which do not interrupt the alternating currents, do not couple any energy into the outer space. The paper sheets can be fed through these gaps and be uniformly fixed in the direction of the longitudinal side.

Since the lines of force in the gaps end on the inside of the metal chamber wall, that is to say can be deflected away from the plane of the paper sheet, the fixing width is in general approximately 1 to 2 mm narrower than the inside width of the resonators. Because of the overlapping of the edge zones the strips of the carrier 15 fixed by the individual chambers close up to one another without gaps, so that wide sheets can be fixed satisfactorily across their entire web width.

The devices shown in FIGS. **1*a* to 9 are designed for the fixing of carriers with a width of 210 mm and 257 mm. The 257 mm wide JB4 image carrier size is fed, for example, symmetrically, through the fixing device, while the 210 mm wide DIN A4 image carrier size is fed through the fixing device asymmetrically, the right-hand carrier edge for either carrier size being fed along the same line. In the first case all six, and in the second case only five, chambers are loaded. Thus there are two different operating settings, that is to say, different immersion depths of the tuning screws 49 (see FIGS. 1*b*, 2*b*) and setting of the matching means in the circuit, such as short-circuit plungers 8, 8' (FIG. 2*c***), which regulate the power distribution.

Oscillation in the chambers is damped by the resistance of the carrier 15 with the toner on it, but because of the connection of the chambers in parallel it is also influenced by the impedance of the remaining chambers.

The resonance-tuning is achieved by the immersion depth of the tuning screws 49 and by the height adjustment of the upper chambers 17. The coupling loops 12*a*, 12*b*, etc., by their shape, size and level setting also determine the resonance behaviour. A fixed setting, which is the same for all resonators, was chosen for the coupling loops of the described embodiments; that is to say, the coupling was fixed. UHF currents can flow via the separation surfaces of the tuning screws 49. Since no transverse currents flow on the inside wall of the chamber perpendicular to the separation plane no UHF energy can leave the narrow gaps, as was mentioned already. Because of slight distortions in the field the gaps, preferably of about 4 mm, deliver only insignificant scattered radiation of approximately 1–2 mW/cm$^2$, and this is not dangerous.

The $H_{101}$ resonators of each row, coupled inductively with their corresponding coaxial feeder lines 12, 12', are uniformly loaded by the carrier 15 running through. When the carrier 15 runs through the two rows are not loaded at the same time, but first the front row 10' then the front and rear row 10', 10'' and lastly the rear row 10''.

Each resonator behaves, after reaching of the resonant frequency, as a parallel resonant circuit of discrete components, which is strongly damped by the effective resistance of the carrier 15 with the toner on it.

In the embodiment according to FIGS. 1*b*, 2*b*, for example, the energy coming from the microwave generator 14, after passing through a circulator and feeding into the T-junction, is divided between the two feeder lines 12, 12', specifically according to the setting of the matching sections in the circuit for 210 mm or 257 mm widths of carrier. This energy is transmitted accordingly by the $H_{101}$ chamber resonators onto the carrier 15.

The energy distribution between the three chamber resonators of a given row is set by the degree of coupling of each chamber. As already discussed, it depends on the immersion depth of the tuning screw 49 and height adjustment of the upper chamber relative to the lower chamber, feed-back effects onto the other chambers resulting because of the connection in parallel. Before a microwave power transmitter 10 is built into a fixing unit, the couplings of the individual resonators must be determined. Subsequently to this the transmitter in the fixing unit is checked for uniform distribution of energy, and, if necessary, the tuning of the individual chambers is corrected.

Since a resonance transmitter is concerned the setting adjustments are slight. Adjustments of 1/10 mm are sufficient to achieve a noticeable change in the distribution.

What is claimed is:

1. A device for fusing and fixing a toner image on a carrier of predetermined web width by means of an electromagnetic radiation field, comprising means for generating microwave energy; and means coupled to said generating means for radiatively transmitting said microwave energy uniformly across the web width of said carrier, said carrier being movable relative to said transmitting means, said transmitting means comprising:

a plurality of discrete transmitting elements arranged in at least two rows, one of said rows lying behind the other in the running direction of said carrier; and a network of waveguides coupled to said generating means for distributing said microwave energy to said discrete transmitting elements.

2. The device of claim 1, wherein said network of waveguides comprises a shared waveguide coupled between said generating means and a waveguide junction; a waveguide junction having an input coupled to said shared waveguide and a branched output coupled to a respective waveguide feeder line for each said row of discrete transmitter elements; a waveguide feeder line for each said row of discrete transmitter elements, each said waveguide feeder line having an input coupled to a respective branched outlet of said waveguide junction; and means for operatively coupling each discrete transmitter element to the respective waveguide feeder line.

3. The device of claim 2 wherein two rows of discrete transmitting elements is provided, and said waveguide junction comprises a T-junction.

4. The device of claim 2 wherein said coupling means comprises an inductive coupling loop operatively connecting each discrete transmitter element to a respective waveguide feeder line.

5. The device of claim 1 wherein said transmitting elements comprise hollow resonant chamber waveguides.

6. The device of claim 5 wherein said resonant chamber waveguides are formed with upper and lower chambers, the upper and lower chambers being spaced apart to form a gap therebetween through which said carrier may pass.

7. The device of claim 6 wherein said gaps between the upper and lower chambers of plurality of discrete transmitter elements are coplanar, whereby a path for said carrier through the fusing and fixing device is defined, the gaps of the first row of discrete transmitter elements in the carrier running direction mutually comprising an entrance gap for said carrier and the gaps of the last row of discrete transmitter elements in the carrier running direction mutually comprising an exit gap for said carrier.

8. The device of claim 1 wherein the discrete transmitting elements of each row are spaced apart within the row and wherein at least one said row is offset relative to the next.

9. The device of claim 1 wherein the discrete transmitting elements are arranged to be substantially coparallel.

10. The device of claim 1 wherein said transmitting elements comprise rectangular hollow waveguides having their longitudinal side walls arranged in the running direction of the carrier.

11. The device of claim 10 wherein the axes of said rows of transmitting elements are substantially co-parallel and are transverse the running direction of the carrier.

12. The device of claim 11 wherein the transmitting elements are spaced apart in their respective rows and said rows are offset from one to the next in a direction parallel to the axis of the rows such that interior longitudinal wall surfaces of transmitting elements in one row align with the interior longitudinal wall surfaces of transmitting elements in the following row in the carrier running direction, whereby substantially uniform transmission of microwave energy across the web width of said carrier is obtained as said carrier is moved relative to said transmitting means.

13. The device of claim 11 wherein the transmitting elements are spaced apart within their respective rows and said rows are offset from one to the next in a direction parallel to the axis of the rows such that interior longitudinal wall surfaces of transmitting elements in one row overlap the interior longitudinal wall surfaces of transmitting elements in the following row in the carrier running direction, whereby at least partially overlapping transmission of microwave energy across the web width of said carrier is obtained as said carrier is moved relative to said transmitting means.

14. The device of claim 1 wherein said rows have equal numbers of transmitting elements.

15. The device of claim 1 wherein said rows have unequal numbers of transmitting elements.

16. The device of claim 1 wherein said rows of transmitter elements are transverse to the carrier running direction at an angle other than 90°.

17. The device of claim 1 wherein each said transmitting element comprises a rectangular hollow waveguide having longitudinal side walls aligned with the running direction of of said carrier, said longitudinal side walls being tapered in the direction toward said carrier.

18. The device of claim 1 wherein means is provided for setting the energy density in said transmitting elements, whereby the relative energy density in the transmitting elements may be modified.

19. The device of claim 18 wherein each said transmitting member includes a cover surface, and said energy density setting means comprises a tuning member in the form of a tuning screw passing through the cover surface of each transmitting member.

20. The device of claim 18 wherein said energy density setting means comprises a short-circuit plunger mounted for sliding adjustment inside each transmitting member, and means coupled to all said plungers for common position adjustment of said short circuit plungers.

21. The device of claim 20 wherein each said transmitting member includes a cover surface, and said common position adjustment means comprises a guide rod fastened to each said short circuit plunger and passing in a sealed manner through the cover surface of the corresponding transmitting member, and a plate to which the free ends of all said guide rods are fastened.

22. The device of claim 21 wherein said plate is resiliently supported above the cover surfaces of said transmitting elements by compression springs.

23. The device of claim 22 wherein two said compression springs support said plate, said compression springs being positioned skew-symetrically about the center line of said transmitting means.

24. The device of claim 1 wherein each said transmitting element comprises an upper chamber and a lower chamber, the chambers of all said transmitting elements being manufactured with precise dimensions so that the relative microwave energy distribution among the transmitting elements will be substantially equal.

25. The device of claim 1 wherein each said transmitting element is formed with an upper and a lower chamber, the chambers being spaced apart to form a gap therebetween through which said carrier may pass, each said chamber being enclosed at its open end with a synthetic film, to prevent ingress of foreign particles into the interior of the chamber.

26. The device of claim 25 wherein said film comprises polytetrafluoroethylene.

27. The device of claim 25 wherein said film comprises copolymers of tetrafluoroethylene and hexafluoropropylene.

28. The device of claim 25 wherein said film is rigidly held at one end by a clamping member, and held under tension at the other end by at least one torsion spring, whereby said film is stretched over the open end of at least one transmitting element chamber.

29. The device of claim 28 wherein a single film covers the openings of all the upper or all the lower transmitting element chambers of the transmitting means.

30. The device of claim 1 wherein each said transmitting element is formed with an upper and a lower chamber, the chambers being spaced apart to form a gap therebetween through which said carrier may pass, and the gaps of the plurality of discrete transmitting elements being coplanar, further comprising a plurality of threads of synthetic material stretched across the openings of all the lower transmitting element chambers of the transmitting means.

31. The device of claim 30, further comprising an entrance feed plate mounted for guiding said carrier into the gaps of the first row of transmitting elements in the carrier running direction, and an exit feed plate mounted for guiding said carrier out of the gaps of the last row of transmitting elements in the carrier running direction, said threads being fastened at one end to said entrance feed plate and at the other end to said exit plate.

32. The device of claim 1 wherein said transmitting elements comprise hollow waveguides having a plurality of ventilation openings.

33. The device of claim 1 wherein each said transmitting element is formed with an upper and a lower chamber, the chambers being spaced apart to form a gap therebetween through which said carrier may pass, and the gaps of the plurality of discrete transmitting elements being coplanar, further comprising a plurality of rotatably mounted rollers, and an endless belt of synthetic material supported on said rollers and passing through said coplanar gaps.

34. The device of claim 1 wherein said transmitting means further includes an opening therethrough, said opening defining a path for said carrier.

35. The device of claim 34 wherein said path is curved.

36. The device of claim 1 wherein said transmitting means comprises three rows of transmitting elements transverse to the running direction of said carrier.

37. The device of claim 1 wherein said network of waveguides comprises a shared waveguide coupled between said generating means and a waveguide junction; a waveguide junction having an input coupled to said shared waveguide and a branched output coupled to a respective waveguide feeder line for each said row of discrete transmitter elements; a waveguide feeder line for each said row of discrete transmitter elements, each said waveguide feeder line having an input coupled to a respective branched outlet of said waveguide junction; and means for operatively coupling each discrete transmitter element to the respective waveguide feeder line, at least one said waveguide feeder line having a longitudinal slot and a movable short-circuit plunger mounted in said slot, the position of said plunger in said slot determining relative distribution of microwave energy among said discrete transmitting elements.

38. The device of claim 37 wherein said short-circuit plunger comprises a plate of synthetic material.

39. The device of claim 37 wherein said short-circuit plunger comprises a block of synthetic material.

40. The device of claim 37 wherein said short-circuit plunger is formed of polytetrafluoroethylene.

41. The device of claim 1 wherein each discrete transmitting element comprises a hollow chamber operatively coupled to said network of waveguides by an inductive coupling loop, said inductive coupling loop having a curved portion projecting into the interior of said hollow chamber.

42. The device of claim 41 wherein said network of waveguides includes a waveguide feeder line for each said row of transmitting elements, each said feeder line comprising a coaxial waveguide having an inner hollow waveguide, said device further including a tubular member enclosing a portion of each said coupling loop.

43. The device of claim 42 further including a contact bolt attached at one end to said inner hollow waveguide and at the other end to said coupling loop, said contact bolt being positioned concentrically within said tubular member.

44. The device of claim 43 wherein one end of said coupling loop is mounted in a blind hole in the end of said contact bolt and the other end of said coupling loop is mounted in a hole in the wall of said tubular member.

45. The device of claim 41 wherein the coupling loops in each row of transmitting elements are arranged parallel to one another, and the coupling loops of two adjacent rows of transmitting elements are non-parallel.

46. The device of claim 45 wherein the coupling loops of one row of transmitting elements are arranged at an angle of 90° with respect to the coupling loops of an adjacent row of transmitting elements.

47. The device of claim 45 wherein the coupling loops of the first row of transmitting elements in the carrier running direction are in the one o'clock position in a plan view of said transmitting means.

48. The device of claim 45 wherein the coupling loops of the last row of transmitting elements in the carrier running direction are in the four o'clock position in a plan view of said transmitting means.

* * * * *

UNITED STATES PATENT OFFICE

CERTIFICATE OF CORRECTION

Patent No. 4,187,405 Dated February 5, 1980

Inventor(s) Herbert A. PUESCHNER and Helmut LEMBENS

It is certified that error appears in the above-identified patent and that said Letters Patent are hereby corrected as shown below:

In column 3, line 25, delete "ecomonical" and replace with -- economical --.

In column 7, line 37, delete "FIGS. 1a and 2A" and replace with -- FIGS. 1a and 2a --.

In column 9, bridging lines 63 and 64, delete "devide" and replace with -- device --.

Signed and Sealed this

*Fourth* Day of *November 1980*

[SEAL]

*Attest:*

SIDNEY A. DIAMOND

*Attesting Officer*

*Commissioner of Patents and Trademarks*